US008926015B2

(12) United States Patent
Viger

(10) Patent No.: US 8,926,015 B2
(45) Date of Patent: Jan. 6, 2015

(54) SUPPORT AND GLIDING MECHANISM FOR CHAIR OR SOFA

(76) Inventor: Denis Viger, Magog (CA)

( * ) Notice: Subject to any disclaimer, the term of this patent is extended or adjusted under 35 U.S.C. 154(b) by 225 days.

(21) Appl. No.: 13/137,108

(22) Filed: Jul. 21, 2011

(65) Prior Publication Data

US 2012/0019036 A1 Jan. 26, 2012

Related U.S. Application Data

(60) Provisional application No. 61/344,437, filed on Jul. 22, 2010.

(51) Int. Cl.
*A47C 3/02* (2006.01)

(52) U.S. Cl.
USPC ..... 297/259.3; 297/270.4

(58) Field of Classification Search
USPC ..... 297/273, 258.1, 259.1, 259.3
See application file for complete search history.

(56) References Cited

U.S. PATENT DOCUMENTS

| | | | | |
|---|---|---|---|---|
| 5,795,028 | A * | 8/1998 | Dussia et al. | 297/440.14 |
| 6,120,095 | A * | 9/2000 | Rogers | 297/273 |
| 6,464,295 | B1 * | 10/2002 | Bergeron et al. | 297/270.4 |
| 7,090,295 | B2 * | 8/2006 | Bodinek | 297/273 |
| 7,134,720 | B2 * | 11/2006 | Viger | 297/270.1 |
| 7,377,587 | B1 * | 5/2008 | Guillot | 297/259.3 |
| 8,336,960 | B2 * | 12/2012 | Lin | 297/270.1 |
| 2003/0015900 | A1 * | 1/2003 | Lu | 297/259.1 |
| 2007/0096522 | A1 * | 5/2007 | Bergeron | 297/270.1 |
| 2007/0262626 | A1 * | 11/2007 | Viger | 297/259.3 |
| 2012/0025573 | A1 * | 2/2012 | Lin | 297/258.1 |

* cited by examiner

*Primary Examiner* — David R Dunn
*Assistant Examiner* — Alexander Harrison
(74) *Attorney, Agent, or Firm* — George A. Seaby

(57) ABSTRACT

A support and gliding mechanism for a chair or sofa includes a base; a post; on the base; a frame on the post including a crossbar on top of the post, and a pair of sides connected to the ends of the crossbar; pivot arms between and pivotally connected to the ends of the frame sides, the arms having bottom ends beneath the crossbar; and a carriage including a top plate for supporting a chair or sofa, and a pair of sides extending downwardly from the top plate with bottom ends pivotally connected to the inside bottom ends of the pivot arms.

9 Claims, 8 Drawing Sheets

SUPPORT AND GLIDING MECHANISM FOR CHAIR OR SOFA

CROSS REFERENCE TO RELATED APPLICATIONS

This application claims priority based on provisional patent application 61/344,437, filed Jul. 22, 2010 in the name of Denis Viger.

FIELD OF THE INVENTION

This invention relates to a support and gliding mechanism for a chair or a sofa.

DESCRIPTION OF RELATED ART

Rocking and gliding mechanisms for chairs or sofas of generally the type described herein are disclosed, for example in U.S. Pat. No. 5,427,433, issued to R. E. Holobough Jr. on Jun. 27, 1995; U.S. Pat. No. 5,947,557, issued to P. Bellefleur on Sep. 7, 1999 and U.S. Pat. No. 6,092,870, issued to C. Desnoyers et al on Jul. 25, 2000, and US Patent Application No. 2003/0015900, published on Jan. 23, 2003 in the name of Chieh-Tsung Hu.

A problem with some currently available mechanisms of the type disclosed by the above-identified patent literature is that the mechanisms, which can be unsightly, are often visible beneath the seat portion of the chair or sofa. Manufacturers often go to considerable expense to hide such mechanisms. Moreover, the mechanisms can be quite complex and/or large, involving many components.

One attempt to give a mechanism of the type in question more eye appeal is found in U.S. Pat. No. 6,092,870, which issued to C. Desnoyer et al on Jul. 25, 2000. The Desnoyer et al chair support mechanism is somewhat bulky and the base of the chair is still visible during rocking.

US 2007/0262626, filed in the name of the present inventor, Denis Viger on May 10, 2006 and published Nov. 15, 2007 discloses a support and gliding mechanism which is relatively simple, compact and aesthetically pleasing. However, the earlier Viger mechanism is somewhat high and needs to be covered so that it cannot be seen. The present invention is designed to meet a need for a glider mechanism which supports a chair or sofa relatively close to the floor.

BRIEF SUMMARY OF THE INVENTION

An object of the present invention is to provide a solution to the above mentioned problems in the form of a relatively simple, compact and aesthetically pleasant support and gliding mechanism for a chair or sofa.

In general terms, the present invention provides a support and gliding mechanism for a chair or sofa including a frame for mounting on a base, which supports the mechanism on a horizontal surface, the frame including a pair of sides and a crossbar extending between the centers of the sides near the bottom edges thereof; a pivot arm extending between the sides of the frame at each end thereof, each pivot arm having a top end pivotally connected to a top free end of the frame side for rotation around a horizontal axis; and a carriage defined by generally inverted U-shaped sides having bottom free ends pivotally connected to bottom free ends of the pivot arms and a top plate extending between the top of the sides for supporting a chair or sofa.

More specifically, the present invention provides a support and gliding mechanism for a chair or sofa comprising:

a base for supporting the chair or sofa on a flat surface;

a post extending upwardly from the base, the post having a bottom end connected to the base and a top end;

a frame on the post including a crossbar mounted on the top end of and extending laterally outwardly from opposite sides of the post, and a pair of sides connected to opposite ends of the crossbar, each frame side having a pair of free ends above and spaced apart from the crossbar;

pivot arms having top ends pivotally connected to the free ends of the frame sides for rotation around parallel horizontal axes, the pivot arms extending downwardly between the frame sides and having bottom ends beneath the level of the crossbar; and a carriage including a top plate for supporting a chair or sofa, and a pair of sides extending downwardly from said top plate, said carriage sides having bottom free ends pivotally connected to the inside bottom ends of said pivot arms, said carriage sides being shorter than said pivot arms, whereby the top plate of the carriage is located in a horizontal plane beneath the free ends of the lower frame sides when the mechanism is in the rest position.

With the above-described mechanism, the top plate of the carriage is located a short distance above the bottom of the lower frame and below the top free ends of the frame sides, and consequently is close to a floor or other horizontal surface supporting the chair or sofa. In effect, the pivot arms are nested in the frame and the carriage is nested in the pivot arms, and hence the mechanism has a low profile.

BRIEF DESCRIPTION OF THE DRAWINGS

The invention is described below in greater detail with reference to the accompanying drawings, which illustrate a preferred embodiment of the invention, and wherein.

DETAILED DESCRIPTION OF THE INVENTION

Figure 1:
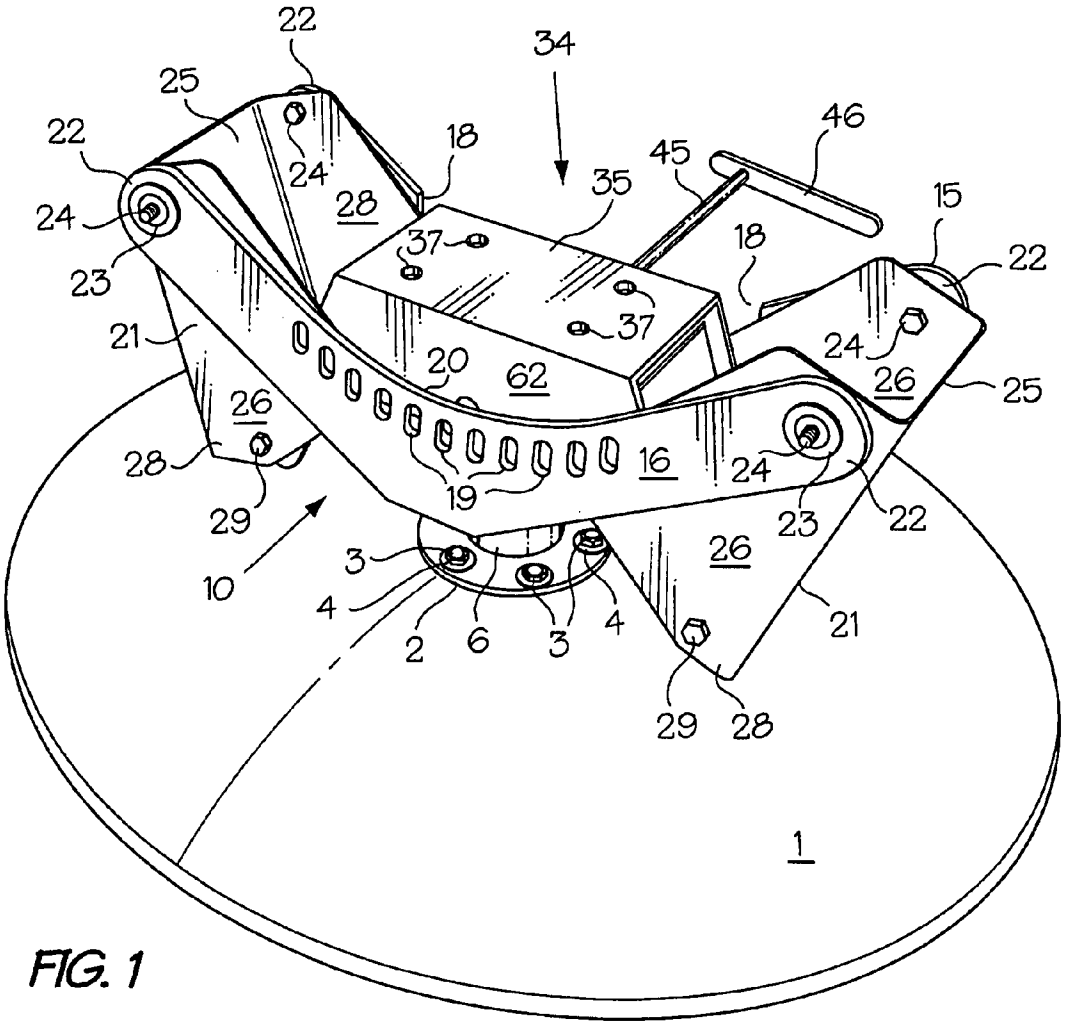
FIG. 1 is an isometric view of a support and gliding mechanism in accordance with the present invention mounted on a base.

Referring to the drawings, the support and gliding mechanism of the present invention is mounted on a large circular base 1; The base 1 is made of wood or plastic and provides a stable support for the mechanism and an article of furniture (hereinafter a glider chair). A circular bearing support 2 is attached to the center of the base 1 using bolts 3, washers 4 and nuts 5. The bearing support 2 includes a cylindrical, upwardly extending, tubular post 6 for receiving a pair of frusto-conical roller bearings 7. (FIG. 5)

A shaft 8 extends downwardly from a crossbar 9 into the post 6. The crossbar 9 forms the bottom end of a frame indicated generally at 10. The crossbar 9 extends laterally outwardly from the top end of the post 6 perpendicular to the longitudinal axis of the mechanism, i.e. perpendicular to the direction of gliding of the mechanism. The shaft 8 is internally threaded for receiving a bolt 11. A washer 12 and the head 13 of the bolt hold the bottom bearing 7 in the post 6. Thus, the lower frame 10 is free to rotate around the vertical longitudinal axis of the bearing support 2.

Figure 4:
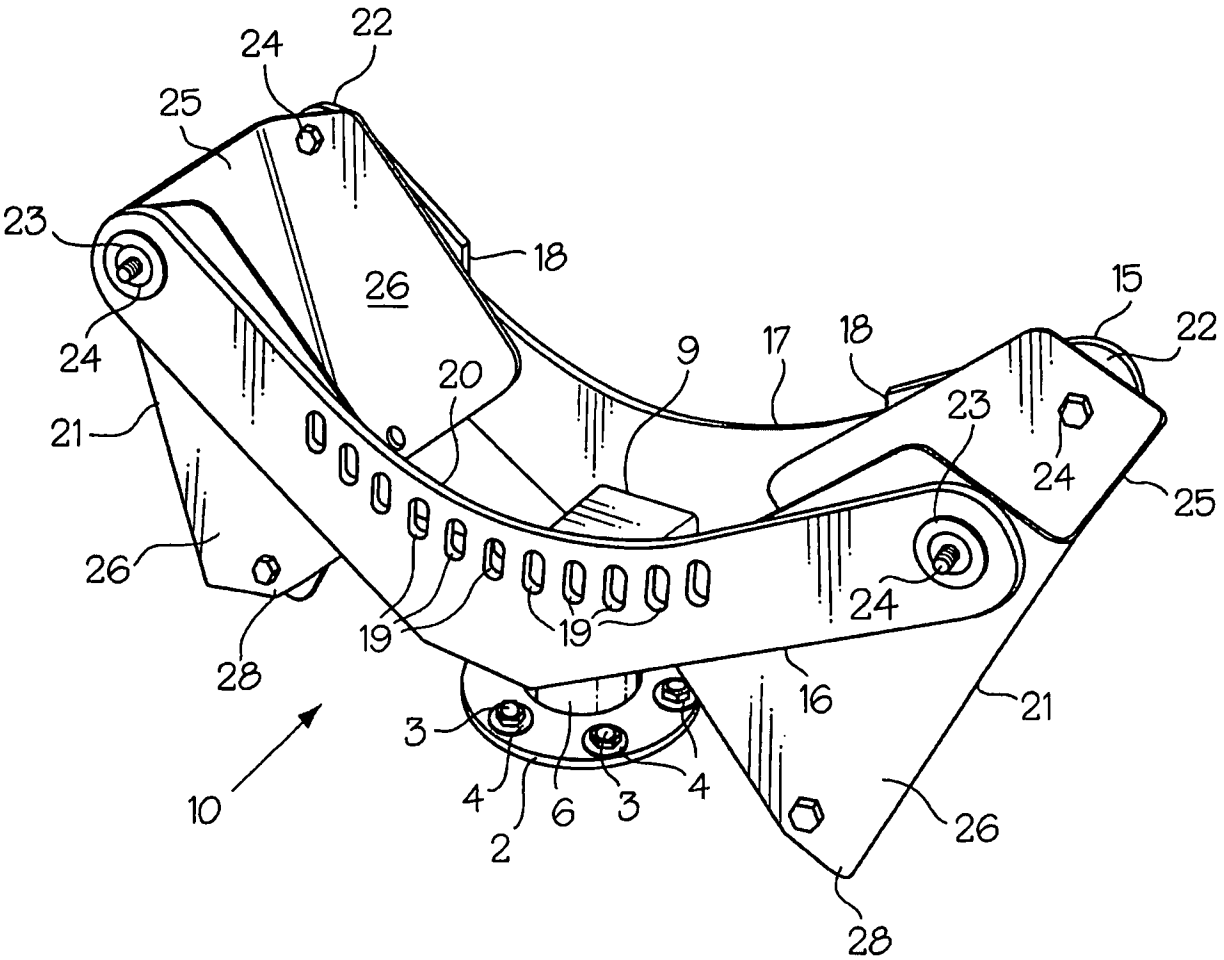
FIG. 4 is an isometric view of the mechanism of FIG. 1 with parts removed.
Figure 5:
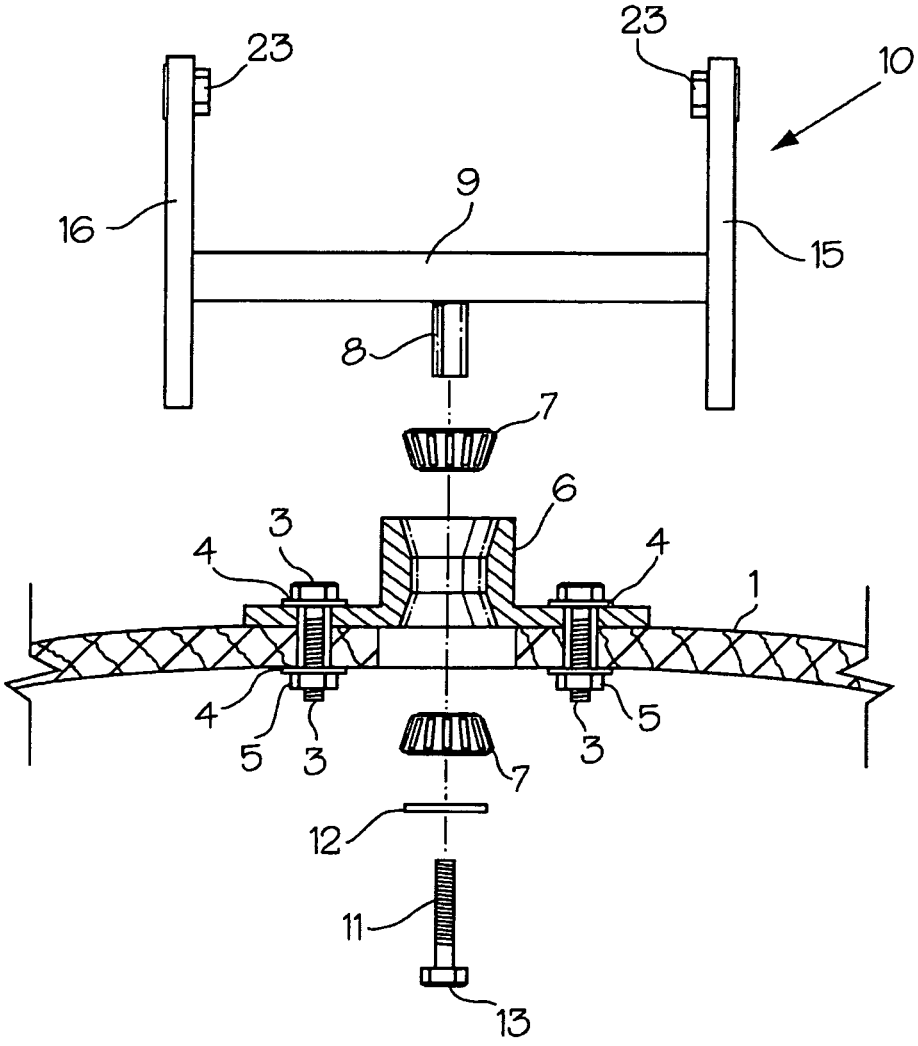
FIG. 5 is a partly sectioned, exploded end view of the mechanism of FIGS. 1 and 2 showing part of a base.

As best shown in FIGS. 4 and 5, the crossbar 9 extends between the bottom center of shallow V-shaped frame sides 15 and 16. One frame side 15 includes a large notch 17 with vertical ends 18 in the top thereof, and the other side 16 includes a plurality of oval slots 19 near the concave top edge 20 thereof for accommodating elements of a latch assembly described in detail thereinafter.

Figure 2:
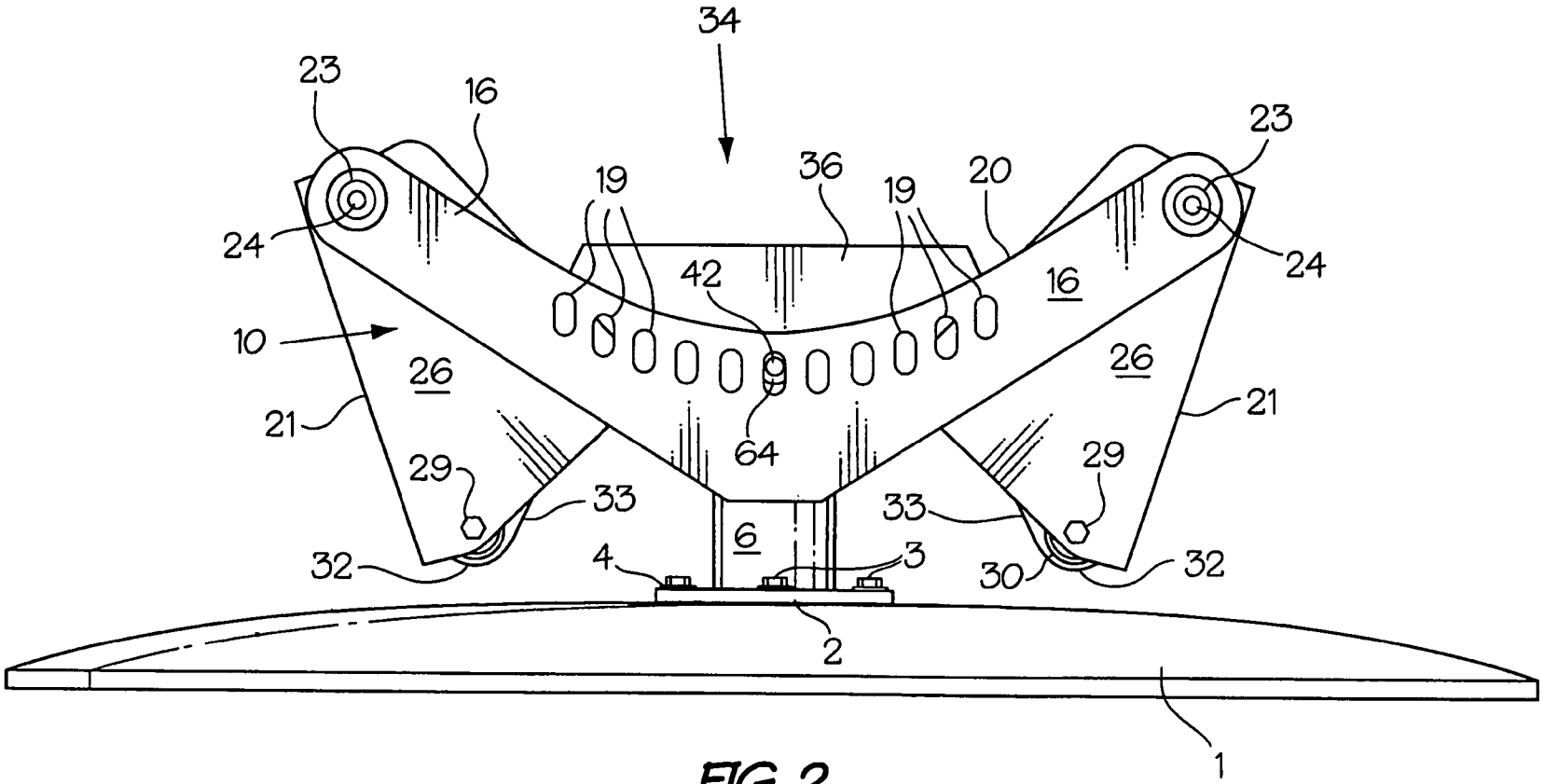
FIG. 2 is a side view of the mechanism of FIG. 1.
Figure 3:
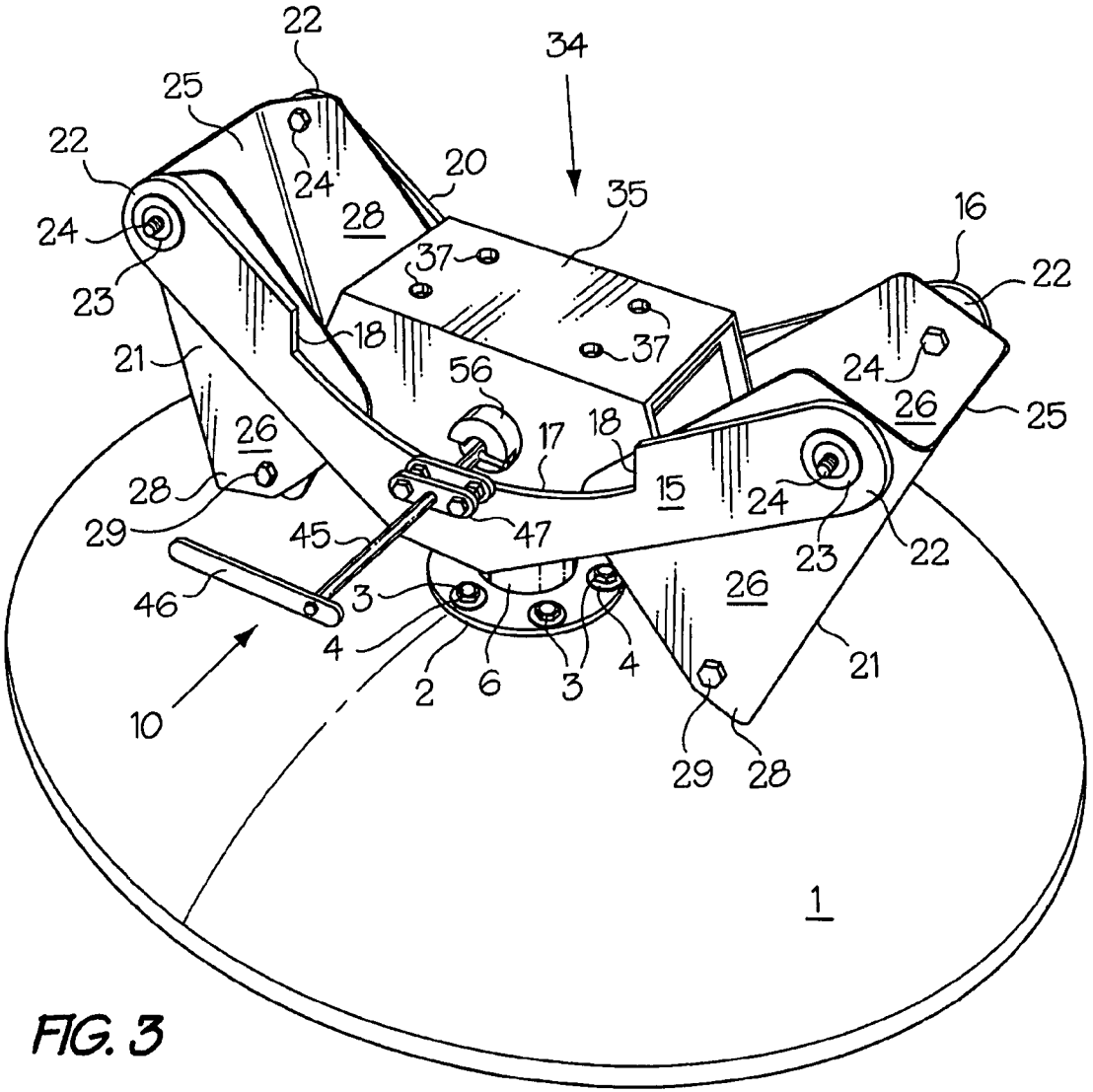
FIG. 3 is an isometric view of the mechanism of FIGS. 1 and 2 as seen from the side opposite to that of FIG. 1.

A pivot arm 21 extends between and is pivotally connected to each top free end 22 of the sides 15 and 16. For such purpose bearings 23 are mounted in the sides 15 and 16 for receiving bolts 24. Each pivot arm 21 includes an end panel 25 integral with a pair of generally triangular sides 26 for receiving the bolts 24. The bottom ends 28 of the sides 26 of the arms 21 receive bolts 29, which are threaded into bearings 30 (FIGS. 2 and 6) in the bottom ends 32 of the legs 33 of a carriage indicating generally at 34 (FIGS. 1, 2 and 6).

Figure 6:
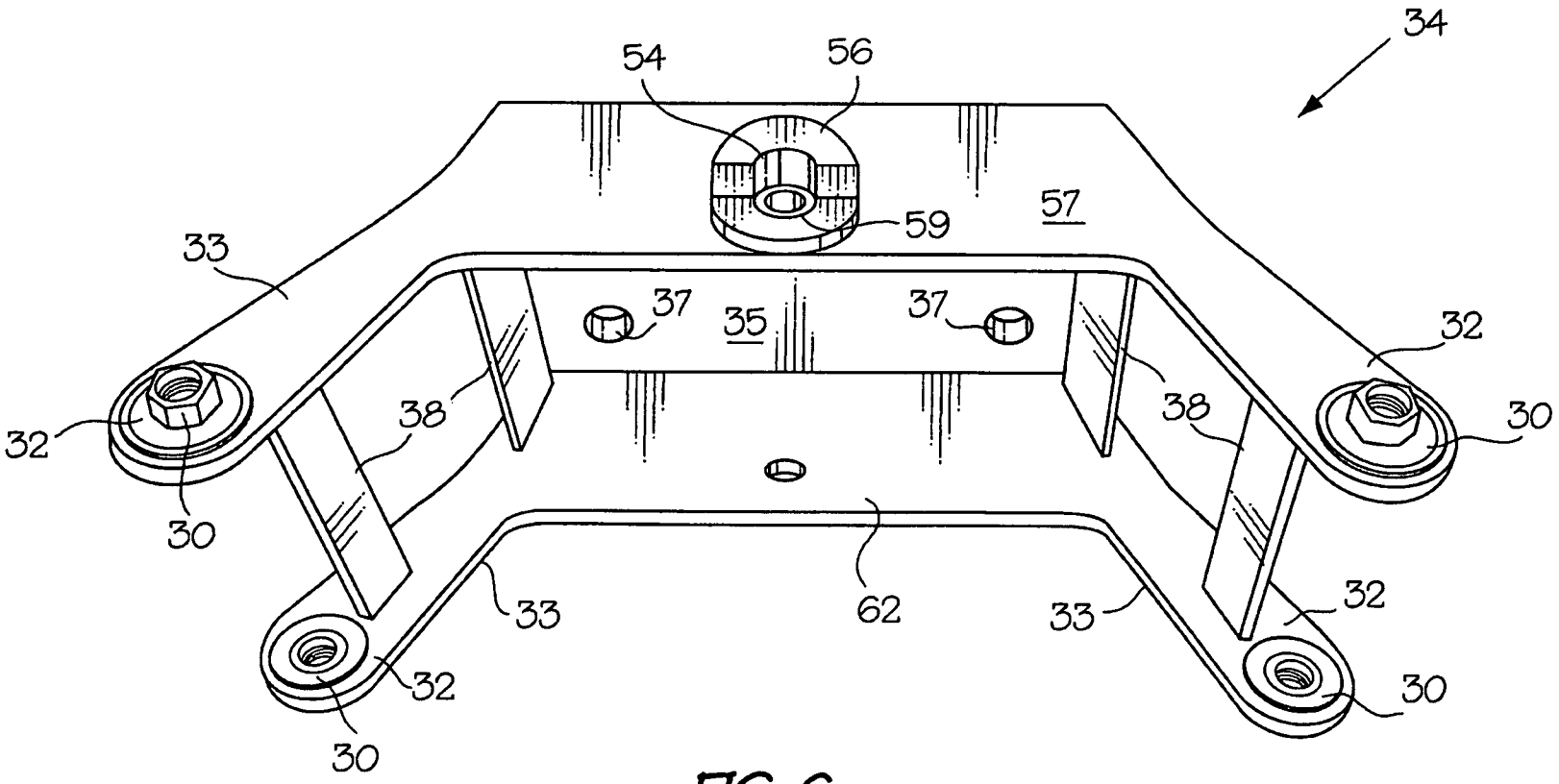
FIG. 6 is an isometric view of a carriage used in the mechanism of FIGS. 1 to 2 as viewed from below.
Figure 7:
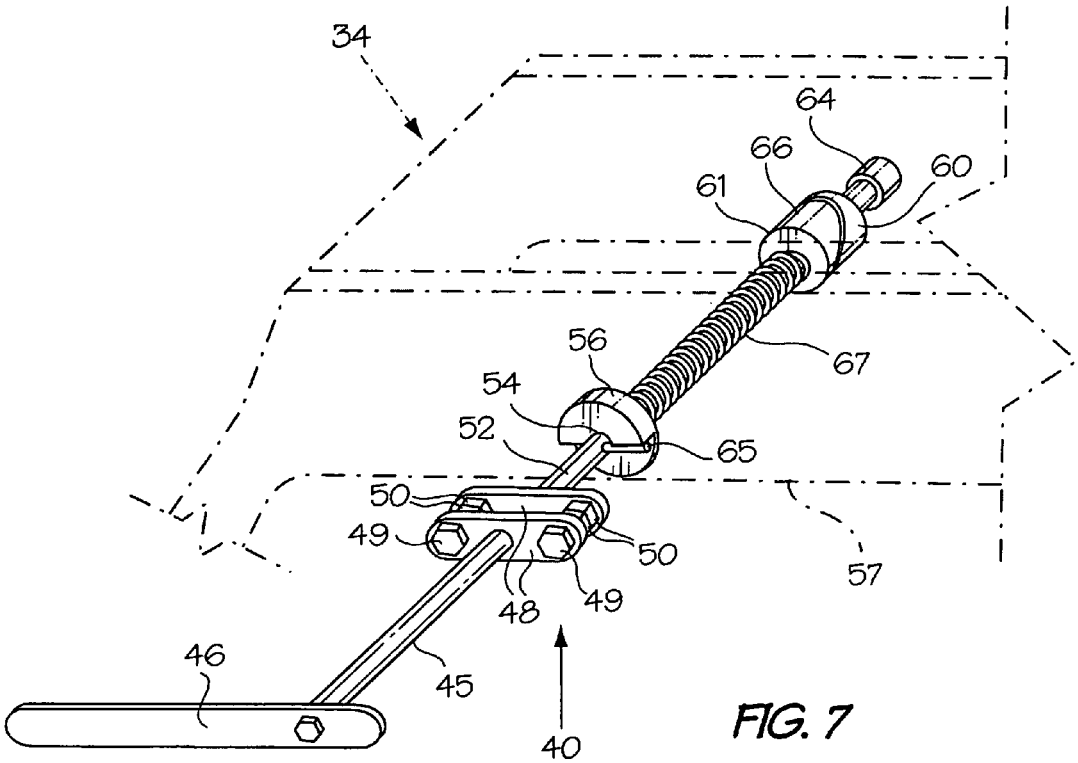
FIG. 7 is an isometric view of a latch assembly used in the mechanism of FIGS. 1 and 2.

Referring to FIG. 6, the carriage 34 is defined by a rectangular top plate 35 with the legs 33 extending downwardly at an obtuse angle from the corners thereof. The carriage 34 has a shallow inverted V-shape with the apex of the V being truncated. Holes 37 are provided in the top plate 35 for receiving bolts (not shown) for connecting the bottom of a chair (not shown) to the carriage 34. Reinforcing crossbars 38 extending between the legs 33 maintain the legs parallel to each other. As mentioned above, the bearings 30 mounted in the bottom free ends 32 of the legs 33 receive the bolts 29, which extend through the bottom ends 28 of the sides 26 of the pivot arms 21 to pivotally connect the carriage 34 to the arms 21. Thus, the carriage 34 is free to glide following an arcuate path of travel parallel to the concave top edge 20 of the frame 10.

Because a glider chair can be difficult to sit down on and get off, particularly for the elderly, a latch assembly indicated generally at 40 (FIGS. 3 and 7 to 9) is provided for releasably latching the carriage 34 in a fixed position in the frame 10. As best shown in FIGS. 3 and 7 to 9, the latch assembly 40 includes an elongated shaft 45 with a handle 46 mounted on the outer free end thereof. The handle 46 defines a lever for rotating the shaft 45 around its longitudinal axis. A coupler 47 defined by a pair of short bars 48, bolts 49 and nuts 50 welded to the bars 48 connect the shaft 45 to a second shaft 52. While a single elongated shaft without a coupler could be used, the use of two shafts and a coupler 47 allow replacement of the outer shaft 45 with a longer or shorter shaft depending upon the width of the chair carried by the mechanism.

Figure 8:
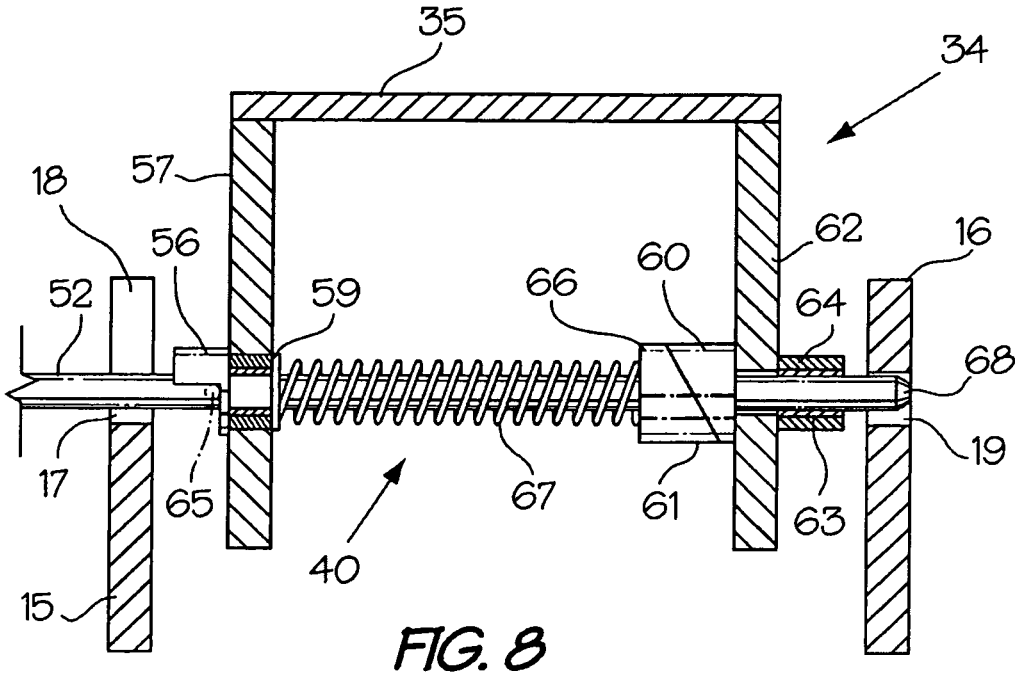
FIGS. 8 and 9 are cross sectional views of a frame and carriage used in the mechanism of FIGS. 1 and 2 showing the latch assembly of FIG. 7 in two positions.
Figure 9:
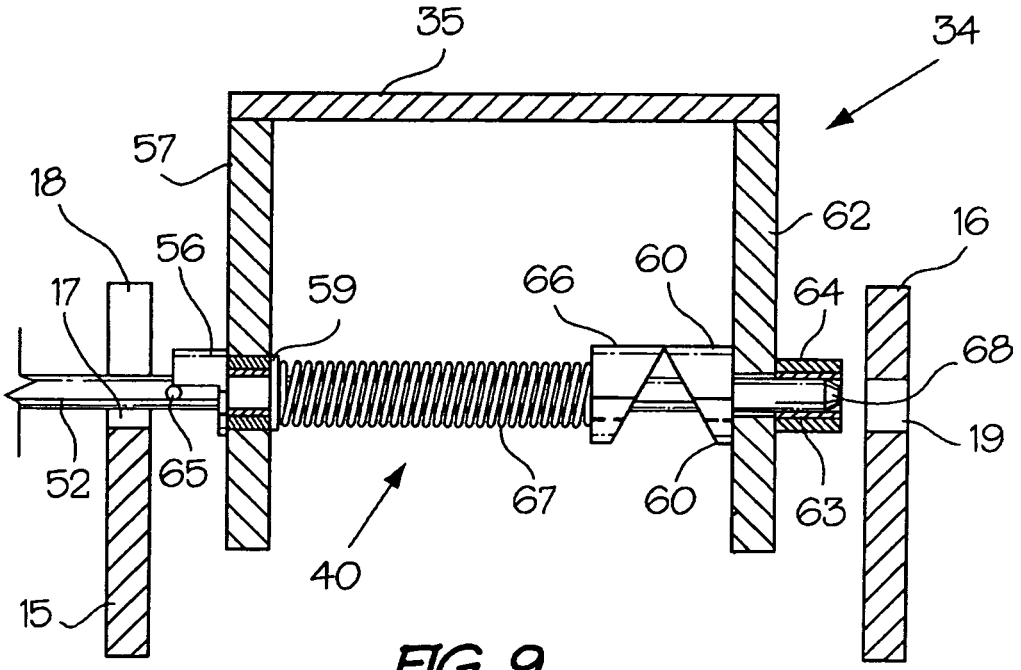

The shaft 52 extends through a notch 54 (FIGS. 3, 8 and 9) in the bottom of a semicylindrical stop 56 mounted on the one side 57 of the carriage 34. The shaft 52 extends through a bearing 59 (FIGS. 8 and 9) in the carriage side 57, through one segment 60 of a cylindrical cam 61 welded to the interior of the other side 62 of the carriage 34 and into a bearing 63 in a sleeve 64 mounted on the exterior of the carriage side 62. A pin 65 extends radially outwardly from the shaft 52 for engaging the flat bottom of the stop 56 for limiting rotation of the shaft 52 to 180° around its longitudinal axis (FIGS. 8 and 9).

A compression spring 67 mounted on the shaft 52 extends between the bearing 59 and a second segment 66 of the cam 61. The cam segment 66 is welded to the shaft 52. The cam segments 60 and 66 include inclined, opposing faces, which can be formed by cutting a cylinder at an angle to its longitudinal axis. With the latch assembly in the latched position (FIG. 8), the end 68 of the shaft 52 extends out of the sleeve 64 into one of the slots 19 in the side 16 of the frame 10, preventing movement of the carriage 34 relative to the frame 10. When the shafts 45 and 52 are rotated using the handle 46, which would be located beside the seat of a chair, the cam segment 66 rotates with the shaft 52 moving the end 68 of the shaft 52 out of the slot 19 into the sleeve 64 (FIG. 9), thereby releasing the carriage and the chair carried thereon. At the limits of travel of the carriage 34, the shaft 45 encounters the vertical ends 18 of the notch 17 in the frame side 15. Thus, the ends 18 act as stops for limiting carriage travel.

Using the latch assembly 40, the carriage 34 and consequently a chair (not shown) mounted thereon can be locked in any one of the plurality of positions. During forward travel, the carriage 34 becomes tilted slightly downwardly toward the front or rear end of the chair. When the carriage 34 is tilted slightly forward, it is easier for a user to dismount from the chair. Of course, it is also possible to latch the carriage in a position where the seat back is inclined rearwardly.

The invention claimed is:

1. A support and gliding mechanism for a chair or sofa comprising a base for supporting the chair or sofa on a flat surface;

a post extending upwardly from the base, the post having a bottom end connected to the base and a top end;

a frame on the post including a crossbar on the top end of and extending laterally outwardly from opposite sides of the post in a direction perpendicular to a longitudinal axis of the mechanism, and a pair of spaced apart sides connected to opposite ends of the crossbar, each frame side being parallel to the longitudinal axis of the mechanism, and each frame side having a pair of free ends above and spaced apart from the crossbar and bottom ends extending downwardly beneath the top end of the post;

pivot arms having top ends pivotally connected to the free ends of the frame sides for rotation around parallel horizontal axes, the pivot arms having sides extending downwardly between the frame sides and having bottom ends beneath the level of the crossbar; and a carriage including a planar top plate for supporting a chair or sofa, and a pair of sides extending downwardly from said top plate between said frame sides and the sides of the pivot arms, said carriage sides having bottom free ends pivotally connected to the inside bottom ends of said pivot arms, said carnage sides being shorter than said pivot arms, whereby the top plate of the carriage is located in a horizontal plane beneath the free ends of the frame sides when the mechanism is in a rest position.

2. The support and gliding mechanism of claim 1, wherein each of said frame sides has a shallow V-shape, and the crossbar extends between the bottom centers of the frame sides.

3. The support and gliding mechanism of claim 2, wherein the carriage top plate is shorter than said frame sides.

4. The support and gliding mechanism of claim 3, wherein said carriage has an inverted V-shape with a truncated top end.

5. The support and gliding mechanism of claim 1 including a latch assembly for releasably latching the carriage to the frame.

6. The support and gliding mechanism of claim 5, wherein said latch assembly includes at least one opening in one side of said frame;

a shaft extending through and rotatably mounted in said carriage sides;

a handle on an outer free end of the shaft for rotating the shaft;

a cam between said shaft and an interior surface of one said carriage side, whereby rotation of said shaft results in longitudinal movement of the shaft between a release position and a latching position in which the shaft extends into said at least one opening in the frame to latch the carriage to the frame.

7. The support and gliding mechanism of claim 6, wherein said latch assembly includes a plurality of openings in said frame for receiving said shaft, said openings being arranged in a row parallel to the path of travel of the shaft and aligned with the longitudinal axis of the shaft when gliding.

8. The support and gliding mechanism of claim 7, wherein said latch assembly includes a stop on the carriage side closest to the handle for limiting rotation of the shaft between the release and latching positions.

9. The support and gliding mechanism of claim 1, wherein said post contains bearings, and the frame includes a shaft extending downwardly into the bearings, whereby the frame, carriage and chair or sofa can be rotated around the longitudinal axis of the post.

* * * * *